US005348196A

United States Patent [19]

Smith et al.

[11] Patent Number: 5,348,196

[45] Date of Patent: Sep. 20, 1994

[54] DISPENSING CANISTER

[75] Inventors: Ernest L. Smith, Kansas City, Mo.; Joseph A. Panelleria, Overland Park, Kans.

[73] Assignee: Sealright Co., Inc., Kansas City, Mo.

[21] Appl. No.: 71,966

[22] Filed: Jun. 7, 1993

[51] Int. Cl.[5] ..... B67D 5/42

[52] U.S. Cl. ..... 222/386; 222/327

[58] Field of Search ..... 222/327, 386, 570; 220/355, 356, 319

[56] References Cited

U.S. PATENT DOCUMENTS

| | | | |
|---|---|---|---|
| 1,695,104 | 12/1928 | Huntley . | |
| 1,727,257 | 9/1929 | Stratton et al. . | |
| 2,055,602 | 9/1936 | Dodge | 222/386 |
| 2,485,142 | 10/1949 | Duncan . | |
| 2,684,791 | 7/1954 | Sebell . | |
| 2,751,073 | 6/1956 | Sheeran . | |
| 2,927,543 | 3/1960 | Sherbondy . | |
| 3,373,898 | 3/1968 | Witzgall . | |
| 3,373,899 | 3/1968 | Witzgall . | |
| 3,884,396 | 5/1975 | Gordon et al. . | |
| 4,027,810 | 6/1977 | Van Manen . | |
| 4,326,650 | 4/1982 | Van Manen . | |
| 4,356,935 | 11/1982 | Kamin . | |
| 4,676,406 | 6/1987 | Frischmann et al. . | |
| 5,088,630 | 2/1992 | Arch et al. | 222/386 X |

*Primary Examiner*—Gregory L. Huson

*Attorney, Agent, or Firm*—Kokjer, Kircher, Bowman & Johnson

[57] ABSTRACT

A dispensing canister for viscous fluids, such as sauces at a fast food outlet. The container includes a peripheral side wall formed of cardboard or other inexpensive material. The side walls are maintained in their proper configuration, and made more rigid, by the use of rigid rings applied to the longitudinal ends thereof. A first end of the container is closed by a plunger which is mounted within the interior of the container side walls and forms the bottom of the container. A trailing edge of the plunger is received within the ring at this first end, to be securely maintained in position. The plunger is formed as a monolithic unit and includes projecting ridges which scrape against the interior of the side walls as the plunger is moved towards a second end of the container. A lid is applied to close the second end of the container. The lid includes a downwardly depending skirt having a catch portion which engages with the rolled ring at this second end. This allows the lid to be applied by a simple downward motion with no ancillary steps required. A dispensing nozzle is formed in the lid and includes a punchout which initially closes the nozzle. A reduced thickness line allows the punchout to be easily removed for dispensing. The lid may be formed as a monolithic unit, such as by injection molding.

6 Claims, 2 Drawing Sheets

DISPENSING CANISTER

BACKGROUND OF THE INVENTION

1. Field of the Invention

The present invention relates in general to canisters for the storage of fluid or semi-fluid materials. In particular, the present invention relates to an improved canister for such materials which includes an integral plunger which may be moved through the container body to extrude the fluid or semi-fluid material from the container.

2. Description of the Related Art

It has been known to provide containers for material having a low viscosity, such as semi-solid or semi-frozen liquid food stuffs which provide a dispensing feature. This is particularly prevalent in the field of sauces and other materials for use in fast food outlets. Such containers typically include an elongated container body having a dispenser opening or spout at a first end and a movable sealing plunger at the second end. The container is placed within an appropriate device for holding the container and the plunger is moved towards the first end containing the spout. This movement of the plunger forces the material within the container through the spout for dispensing. Examples of such containers are shown in U.S. Pat. Nos. 2,927,543 to Sherbondy, 3,884,396 to Gordon, et al., 4,326,650 to Van Manen, and 4,356,935 to Kamin.

One of the concerns with such containers is the seal provided between the plunger and the interior side wall of the container. A poor seal will allow moisture and air to pass into the container, causing contamination or spoilage of the material to be dispensed. Additionally, an effective seal against the interior side wall will ensure that the maximum amount of material is dispensed from the container, rather than passing between the plunger and the container side wall. One arrangement to provide a better seal is shown in U.S. Pat. No. 4,027,810 to Van Manen. This reference shows a plunger having a soft resilient material surrounding a rigid core. The soft material conforms to the interior of the container to provide an effective seal.

While the sealing characteristics of this plunger are adequate, the two-part construction raises the cost of the container. Additional factors which raise the cost of such containers, and make them less attractive, are the junctions between the plunger and the container in its initial condition, the junction between the container side wall and the lid of the container and the initial seal across the dispensing spout. To provide adequate seals against contamination and leakage, these junctions and seals are typically of a complicated nature requiring several assembly steps. This of course increases the cost of such containers.

SUMMARY OF THE INVENTION

An object of the present invention provide a canister which allows the storage and dispensing of a viscous fluid material.

Another object of the present invention is to provide such a canister which may be easily filled with the material, and which may easily dispense the material.

Another object of the present invention is to provide such a canister which includes a movable plunger forming one end of the canister, with this plunger having an effective seal against the interior of the container side wall.

Yet another object is to provide such a container in which the plunger may be easily and securely retained in its initial position.

Yet another object of the present invention is to provide a lid at a second end of the container which may be applied thereto in a single step, yet is securely retained thereon.

Yet another object of the preset invention is to provide such a lid which includes a dispensing nozzle which is securely closed during storage, yet may be easily opened for use.

These and other objects are achieved by a dispensing canister for viscous fluids, such as sauces at a fast food outlet. The container includes a peripheral side wall formed of cardboard or other inexpensive material. The side walls are maintained in their proper configuration, and made more rigid, by the use of rigid rings applied to the longitudinal ends thereof. A first end of the container is closed by a plunger which is mounted within the interior of the container side walls and forms the bottom of the container. A trailing edge of the plunger is received within the ring at this first end, to be securely maintained in position. The plunger is formed as a monolithic unit and includes projecting ridges which scrape against the interior of the side walls as the plunger is moved towards a second end of the container. A lid is applied to close the second end of the container. The lid includes a downwardly depending skirt having a catch portion which engages with the rolled ring at this second end. This allows the lid to be applied by a simple downward motion with no ancillary steps required. A dispensing nozzle is formed in the lid and includes a punchout which initially closes the nozzle. A reduced thickness line allows the punchout to be easily removed for dispensing. The lid may be formed as a monolithic unit, such as by injection molding.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
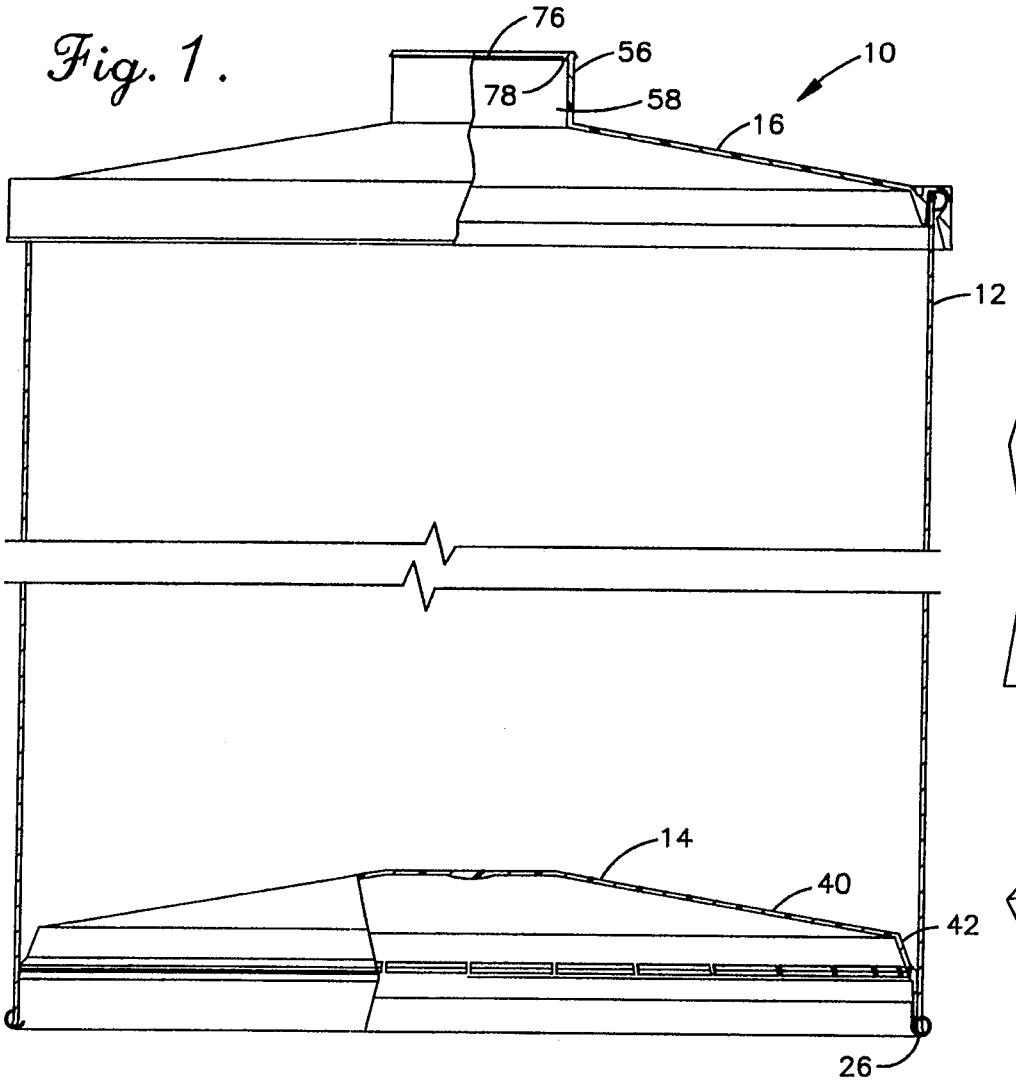
FIG. 1 is a side view, in partial cutaway of a container according to the present invention.

With reference to FIG. 1, a container according to the present invention is generally designated by reference numeral 10. The container 10 generally consists of a side wall 12, plunger 14 and cap 16.

Figure 2:
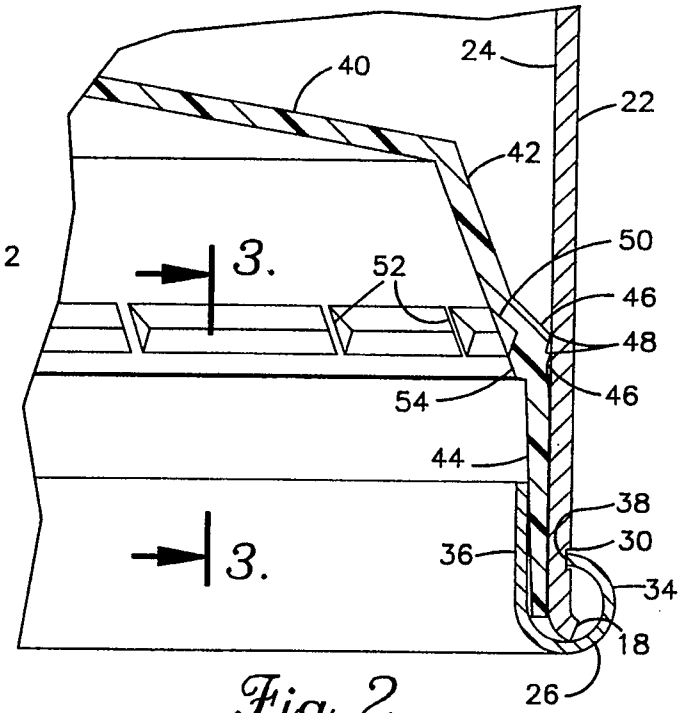
FIG. 2 is a detail view in cross-section showing the plunger in the initial position.
Figure 4:
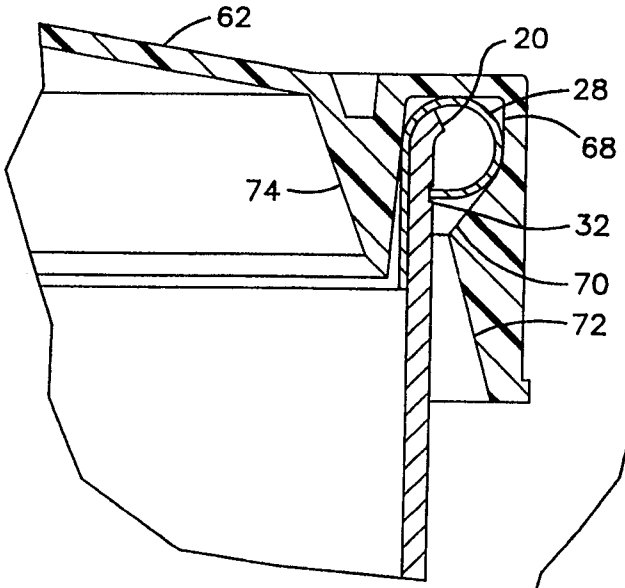
FIG. 4 is a detail view in cross-section showing the attachment of the lid to the side wall.

The side wall 12 defines a closed periphery extending between a first edge 18 (FIG. 2) and a second edge 20 (FIG. 4). The side wall 12 may be formed of a variety of materials and be formed into a variety of cross-sectional configurations, but is preferably formed of spiral wound paper and formed into a cylinder. The closed periphery of the side wall defines an exterior face 22 and an interior face 24 (FIG. 2). Depending upon the material to be placed within the container 10, the interior face 24 may be provided with a plastic coating or laminate to form a barrier between the product and the side wall. A wax coating may also be employed, but is not preferred for reasons discussed below.

Mounted upon the first and second edges of the side wall are first and second end rings 26 and 28, respectively. Specifically, the side wall 12 is provided with first and second ring grooves 30 and 32, each spaced from an associated one of the edges 18 and 20. Each of the ring grooves extends about the periphery of the side wall 12. Each of the end rings 26 and 28 also extend about the entire periphery of the side wall, and include a rolled portion 34 and a substantially straight portion 36, in cross-section.

The rolled portion 34 extends from a first edge 38, received within the respective one of the ring grooves 28 or 30, and curves about to encompass the respective first or second edge 18 or 20. The rolled portion 34 transitions into the straight portion 36 at an appropriate tangential point on the rolled portion such that the straight portion 36 extends substantially parallel to the side wall 12. As is best shown in FIG. 4, the second end ring 28 is formed such that the straight portion 36 (and a portion of the rolled portion 34) are in abutment with the interior face 24 of the side wall 12. The arrangement of the first end ring 26 will be explained below.

The end rings are preferably formed of metal such that they may be fixed upon the side wall 12 by plastic deformation. This deformation is sufficient to ensure that the rings are tightly held about the side wall 12, with the first edge 38 urged toward the straight portion. Additionally, the placement of the first edge 38 within the respective ring grooves 30 and 32 restricts movement of the rings away from the side wall in the longitudinal direction. The use of the metal end rings provides a structural soundness to the side wall 12 and helps to maintain the side wall configuration, as is known in the art. However, in the present invention the end rings are additionally employed for other purposes.

A first example of this is the restraint of the plunger 14 within the container. The plunger 14 includes at its innermost end, with respect to the container, a domed portion 40. The domed configuration provides structural strength to the plunger 14 but is not strictly necessary. For example, the domed portion could be formed as a substantially planar portion with appropriate reinforcement ribs, if necessary. The domed portion includes an outer periphery which substantially corresponds to that of the side wall 12. Connected to the outer periphery of the domed portion 40 is a transition portion 42. The transition portion preferably extends towards the first edge 18 to compliment the domed portion 40. Extending downwardly from a lower end of the transition portion 42 is a skirt 44. The skirt 44 extends towards the first edge 18, such that the entire plunger has a concave configuration towards this first edge. To reduce material costs, it is preferred that the plunger have a substantially uniform thickness, such that this concave configuration is also present on the underside or exterior side of the plunger.

The skirt 44, being essentially an extension of the domed portion 40, has a peripheral configuration substantially corresponding to that of the side wall 12. The skirt 44 preferably has a close sliding tolerance with the interior face 24 of the side wall. This will help to ensure that air and moisture do not ingress into the container to contaminate the product therein, and that the product will not pass between the skirt 44 and the interior face of the side wall during use. As such, skirt 44 assists in forming a seal for the plunger 14.

The formation of the seal is assisted by the presence of one or more peripheral ribs 46 formed on the exterior of the plunger 14 at a position intermediate the transition portion 42 and skirt 44. As is best shown in FIG. 2, each of the ribs 46 is substantially triangular in cross-section and includes a crown or apex 48 spaced peripherally outward with respect to the immediately adjacent portions of the plunger 14. The crowns of the ribs may extend peripherally outward of all portions of the plunger 14, including the skirt 44, or may have an outer periphery substantially corresponding to that of the skirt. Either arrangement will ensure that the crowns of the ribs are in very close sliding engagement with the interior face 24 of the side wall 12. As such, the crowns of the ribs will act as scrapers to help ensure that product does not pass behind the plunger 14, and will additionally act as seals to ensure that moisture and air do not enter the container.

Where the plunger is formed with the preferred substantially constant thickness, the ribs 46 extending peripherally outward the respect to immediately adjacent sections of the plunger will result in corresponding depressions in the underside face of the plunger, as illustrated by groove 50. Such grooves may provide a point for the concentration of stresses which could cause failure of the plunger material.

Figure 3:
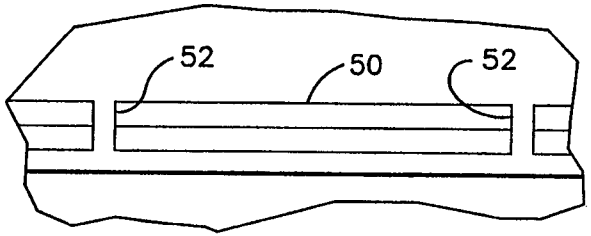
FIG. 3 is a detail view along lines 3—3 of FIG. 2.

To prevent such failure the plunger may be provided with a plurality of reinforcing ribs 52 which extend across the groove 50, as best shown in FIG. 3. Alternatively, a thickened portion may be provided in the area corresponding to ribs 46. Such a thickened portion may conveniently take the form of a continuation of the underside face from the transition portion 42. It is also possible to provide both of these structures 52 and 54 within a single plunger 14. This is best shown in FIG. 2 where the plunger maintains a substantially constant thickness for the uppermost of the peripheral ribs 46, with the interior of the plunger being provided with ribs 52 across the resulting groove 50, and a thickened portion 54 is formed in the area of the lower peripheral rib 46.

A second example of an additional use for the end rings is the retention of the cap 16. The cap 16 includes a neck 56 or other arrangement to provide an opening 58 therethrough to provide an exit for the contents of the container 10. Where a neck 56 is employed, it may be desirable to form an outward peripheral lip 60 in proximity to the free end of the neck such that the peripheral lip will serve to maintain a conduit for the contents in position upon the neck.

Connected to and supporting the neck 56 is a main body 62 which extends from the neck 56 to the sidewall 12 of the container. The main body preferably has a shape in the form of a frustrum of a cone for increased strength, although other configurations are possible. The main body includes an outer periphery 64 which corresponds substantially to that of the sidewall 12.

Connected to the outer periphery 64 is engagement means for connecting the cap 16 to the second end ring 28. This engagement means may take the form of a peripheral skirt 66 which extends in a direction from the second end ring to the first end ring. The cap 16 is formed to rest in the applied position with the undersurface of the main body 62 in close proximity to the second end ring 28. As such, the skirt 66 includes a first portion 68 adjacent the main body 62 which has an outer peripheral length substantially equal to that of the outer most portion of end ring 28, such that this first portion may be located peripherally outward of the end ring. A second portion 70 of the skirt 66 is located below (i.e., in the direction of first end ring 26) the first portion 68. This second portion has a reduced peripheral length such that this second portion is spaced at least somewhat peripherally inward with respect to the outermost portion of end ring 28, such that this second portion forms a catch which may retain the skirt, and thus the cap 16, in position upon the end ring 28.

It is preferred that the skirt 66 be formed of a material with sufficient resiliency that the second portion 70 may be bent peripherally outward to allow the cap to be placed upon the end ring 28, yet will return to its original position to extend inward of the end ring and thus retain the cap in place. To assist in this placement of the cap upon the end ring, it is preferred that the skirt additionally include a third portion 72 located downward with respect to the second portion 70. The third portion 72 will provide a substantially smooth transition from the reduced periphery of the portion 70 to the lower end of the skirt 66, which has a peripheral length greater than that of second portion 70. As such, this third portion 72 will act as a camming surface to aid in the outward expansion of the skirt 66 to allow the second portion 70 to pass over the ring 28.

While this arrangement may be sufficient for some purposes, it is preferred that the cap 16 be provided with means for forming a better seal with the end ring 28. To this end, the cap 16 is provided with a sealing lip 74 extending downward from the main body 62 and spaced inward from the skirt 66 about the entire periphery of the main body 62. The spacing of the sealing lip from the skirt in preferably substantially equal to the width of the second end ring 28, such that the first portion 68 of the skirt 66 and the outer peripheral face of the sealing lip 74 will both be in contact with the end ring 28. This arrangement, in conjunction with the possible contact of the main body 62 upon the upper portion of the end ring 28, will provide a sufficient seal for a wide variety of contents. As with the third portion 72 of the skirt, the outer peripheral face of the sealing lip may taper peripherally inwardly towards the first end ring 26 to aid in placement of the cap over the second end ring 28.

To reduce costs and increase the integrity of the container 10, the cap 16 may be formed as a monolithic plastic element, formed for example by injection molding. As may be readily envisioned, this will allow the caps 16 to be easily mass produced at extremely low unit costs. Additionally, since the cap is a monolithic unit there is no danger of leakage through the cap, as there are no joints.

It should also be apparent that the configuration of the present cap allows it to be easily assembled to the sidewall 12 by a simple downward movement. This is an extremely simple process and does not require complicated machinery as in the prior art. In certain situations, the cap may of course be applied by hand, and this simple assembly allowed by the cap construction facilitates the manual application of the cap.

Where the cap is formed as a monolithic unit a closure for the opening 58 may be advantageously formed as an integral portion of the cap 16. For example, FIG. 1 shows a punch out 76 in the form of a planar element extending across and blocking the opening 58. This punch out 76 is a monolithic portion of the remainder of the cap 16. A reduced thickness line 78 is formed about the juncture of the neck 56 and punchout 76, such that the reduced thickness line may act as a tear line for removal of the punch out 76. The punch out would be removed at the final destination of the container just prior to dispensing of the contents therefrom.

Figure 5:
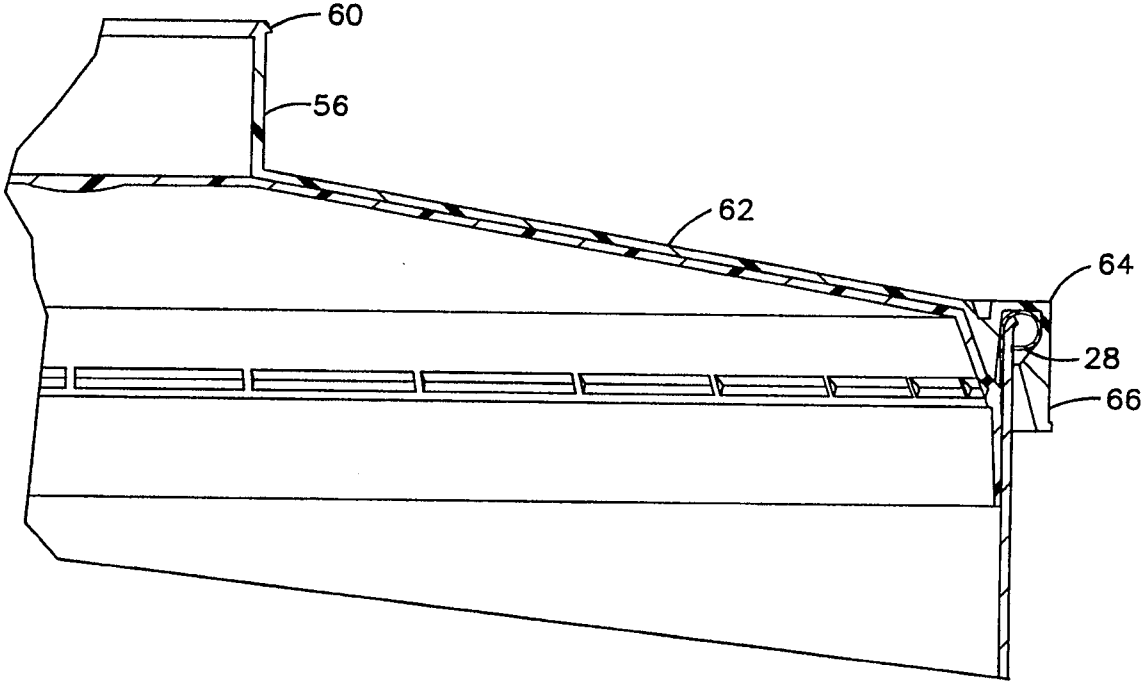
FIG. 5 is a detail view in cross-section showing the plunger in its final position.

To ensure that the maximum amount of the contents are dispersed from the container, it is additionally preferred that the cap 16 and plunger 14 are so configured to define a mating relationship when in contact, so that there are few if any voids between these elements which may act as reservoirs for material not dispensed. As is best shown in FIG. 5, the frustoconical configuration of the main body 62 of the cap may correspond to the domed portion 40 of the plunger 14. Additionally, the peripherally inner face of the sealing lip 74 may mate with the transition portion 42 of the plunger, and possibly some or all of a face of the uppermost peripheral rib 46.

The construction and operation of the container according to the present invention will now be described. Initially, a plurality of the caps and plungers are mass produced, and a quantity of the material forming the sidewall and end rings is also produced. These materials are then transferred to the packing sight. Employing an assembly machine of known design, the material 10 forming the sidewall 12 is formed into a tube and the end rings 26 and 28 are applied thereto. The plunger 14 is placed in position prior to attachment of the first end ring 26, such that the plunger is retained in position by this end ring, as shown in FIGS. 1 and 2. At this point the container will have a sidewall and a bottom (formed by the plunger 14) and is sufficiently ridged to receive the contents of the container. Upon receipt of the contents within the container, the cap 16 is applied by a simple downward pressing motion, thus completing the container 10.

The container is been transferred to the intended sight for use, where it may undergo a period of storage. During this time the monolithic nature of the cap and plunger, and the seal provided between the plunger and sidewall, and cap and second end ring, assures that the contents will be maintained in a fresh condition. When the container is ready for use, the user will take a sharp object and remove the punch out 76 by tearing along the reduced thickness line 78.

Once the punch out 68 has been removed a conduit or hose (if employed) may be connected to the neck 56. The container may then be placed in an appropriate device having a ram to apply pressure to the plunger 14 to move the plunger towards the cap 16. This movement will of course reduce the volume of the container, thus forcing the contents of the container to pass through the opening 58. As the plunger is moved towards the cap 16 it is dislodged from its position intermediate the straight portion 36 of the first end ring 28 and the sidewall 12. By virtue of the ring groove 30 and the nature of the material employed to form the second end ring 28, this straight portion 36 will move towards the sidewall 12 and the first end ring 26 will thus be maintained in position.

The plunger will continue to move towards the cap 16 with continued application of pressure, causing extrusion of the contents of the container, until it is placed in abutment against the cap 16. During this movement, the contents of the container apply pressure to the cap 16 in a direction tending to force it to be removed from the sidewall 12. However, the use of the skirt 66 ensures that the cap will be retained in position. When the plunger has reached the abutting position with the cap 16, the mating nature of the cap and plunger ensures that a maximum amount of the material has been displaced. This is also aided by the peripheral ribs 46 which scrape along the interior sidewalls 12 during movement of the plunger, ensuring that the contents of the container are not contaminated nor wasted.

From the above description it may be seen that the container according to the present invention may be manufactured with low cost, will provide excellent sealing capabilities to maintain the product in a fresh condition, and will reliable dispense a maximum amount of contents.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A dispensing container, comprising:

at least one peripheral side wall;

a plunger located at a first end of said at least one side wall, said plunger having a skirt and having an outer periphery in close sliding contact with an interior face of said at least one side wall and being capable of movement toward a second end of said at least one side wall, said plunger including at least one peripheral rib extending peripherally outward, said plunger and rib being a monolithic unit;

a first end ring mounted upon and extending about the periphery of said first end, said plunger skirt being located intermediate a portion of said end ring and said at least one side wall in an initial position prior to said movement of said plunger;

a second end ring mounted upon and extending about the periphery of said second end of said at least one side wall; and a cap connected to said second end ring and including an opening for the contents of the container to pass therethrough during said movement of said plunger.

2. A container as in claim 1, wherein said at least one rib comprises a plurality of said ribs.

3. A container as in claim 1, wherein said cap includes a peripheral skirt extending toward said first end and located peripherally outward of said second end ring, said skirt including a portion adjacent said second end ring, and between said first end second end rings, extending peripherally inward with respect to an outermost segment of said second end ring, whereby said portion retains said cap on said end ring and thus said at least one side wall.

4. A container as in claim 3, wherein said cap further includes a peripherally extending sealing lip extending toward said first end and located peripherally inside, but in close proximity to, said second ring.

5. A container as in claim 4, wherein an underside of said cap, including said sealing lip, substantially conforms to an upper side of said plunger, whereby said plunger and said cap substantially mate when said plunger has completed said movement to minimize the volume within said container.

6. A container as in claim 4, wherein said cap, including said skirt of said cap and said sealing lip, is a monolithic unit.

* * * * *

UNITED STATES PATENT AND TRADEMARK OFFICE

CERTIFICATE OF CORRECTION

PATENT NO. : 5,348,196

DATED : September 20, 1994

INVENTOR(S) : SMITH, Ernest L. and Joseph A. Pantelleria

It is certified that error appears in the above-identified patent and that said Letters Patent is hereby corrected as shown below:

On the title page:

item [75] Inventors: Ernest L. Smith, Kansas City, MO; Joseph A. Pantelleria, Overland Park, Kans.

Signed and Sealed this

Fifth Day of September, 1995

*Attest:*

Bruce Lehman

BRUCE LEHMAN

*Attesting Officer*

*Commissioner of Patents and Trademarks*